US006769206B2

(12) United States Patent
Olson

(10) Patent No.: US 6,769,206 B2
(45) Date of Patent: Aug. 3, 2004

(54) MULTIFORM-CAPABLE PRODUCT DISPLAY APPARATUS

(76) Inventor: Adrian Michael Olson, 238 Melody La., Watsonville, CA (US) 95076

( * ) Notice: Subject to any disclaimer, the term of this patent is extended or adjusted under 35 U.S.C. 154(b) by 0 days.

(21) Appl. No.: 10/390,236

(22) Filed: Mar. 14, 2003

(65) Prior Publication Data

US 2003/0172565 A1 Sep. 18, 2003

Related U.S. Application Data

(60) Provisional application No. 60/364,542, filed on Mar. 15, 2002.

(51) Int. Cl.[7] ..... G09F 1/08
(52) U.S. Cl. ..... 40/538; 40/611; 248/459
(58) Field of Search ..... 40/538, 610; 248/459

(56) References Cited

U.S. PATENT DOCUMENTS

| | | | | | |
|---|---|---|---|---|---|
| 1,577,207 | A | * | 3/1926 | Dieperlink-Langereis | 428/8 |
| 1,840,622 | A | * | 1/1932 | Einson et al. | 40/539 |
| 2,188,081 | A | * | 1/1940 | Guthrie | 428/8 |
| 2,349,706 | A | * | 5/1944 | Collins | 40/538 |
| 3,570,728 | A | * | 3/1971 | DeWitt et al. | 223/75 |
| 5,911,328 | A | * | 6/1999 | Shampo | 211/40 |
| 6,604,979 | B1 | * | 8/2003 | Liu | 446/256 |

* cited by examiner

*Primary Examiner*—Cassandra H. Davis
(74) *Attorney, Agent, or Firm*—Donald R. Boys; Central Coast Patent Agency, Inc.

(57) ABSTRACT

Product displays are provided having planar elements suggesting three-dimensional entities, and indication product class and/or product type visible from a distance.

6 Claims, 3 Drawing Sheets

MULTIFORM-CAPABLE PRODUCT DISPLAY APPARATUS

CROSS REFERENCE TO RELATED DOCUMENTS

The present non-provisional patent application claims priority to provisional application serial No. 60/364,542, filed on Mar. 15, 2002. The entire disclosure of provisional application 60/364,542 is incorporated herein by reference.

FIELD OF THE INVENTION

The present invention is in the field of product display apparatus for presenting products in a public setting, and pertains particularly to apparatus and methods for displaying products including product classes and categories using a same generic display base or constructed form capable of accepting a plurality of product class specific and/or product specific substantially planer members that function to indicate product class and/or type.

BACKGROUND OF THE INVENTION

The art of creating display paraphernalia for public display of advertised products is one of the oldest of arts known. It is well-known that there are many existing varieties and styles of apparatus created specifically for product display that differ widely from one another in terms of design and construction. For example, there are folding backdrops, shelved backboards, pedestals, carousels, display cases, hanging racks, pinned backboards and all manner of other construction types available.

Generally speaking, successful public display of specific products or product classes requires considerable thought as to how the offered products will be presented to the public eye. For example, should the products be displayed at eye level? Should the products be presented with automated movement? What lighting levels should be applied if any? How far from a display location of the products should an indication of product class or type such as a banner or sign be visible and discernable?

There are many other questions in addition to the ones stated above that have arisen in the field and have had to be answered in some way before a quantifiable measure of success could be realized from how products are displayed. In the case of some product types, a proper display determines success or failure of a specific display presentation, with performance measured in number of units sold from the display over a given period of time. The art of creating product display environments is a science that takes considerable time to master.

An unsolved problem with conventional display apparatus is the generic nature of the display itself For example, a simple bookshelf can be used to display a wide variety of different products. However the physical presence and form of the bookshelf itself does not in any way indicate, for example, from any distance, exactly what products are presented in the display. Another example is a rotating pedestal display with product hooks or pins. The pedestal can present almost any product that can be suspended from a hook or pin, however indication of product class or specificity is not immediately discernable from a distance.

A solution to this problem has typically been to provide a sign that can be elevated above or near the display in some fashion to be visible from a distance, the sign telling the public at least the class type of the displayed product. Products displayed in front of folding backdrops rely on the banner displayed on the backdrop to identify the product class or product specificity. However, if one decides to change the product displayed from, for example, one product class to another in a same generic display, new signs have to be constructed or at least physically provided in place of the former signs.

What is clearly needed is a generic display base or constructed form that can accept one or more product class-specific or product-specific indicators for advertising display of each of disparate products in a manner that advertises the basic theme of the displayed product and wherein the advertised theme is recognizable from a considerable distance.

SUMMARY OF THE INVENTION

In a preferred embodiment of the present invention a display construction for presenting products to the public is provided, comprising a construction base, and one or more planer members interfaceable to the construction base, characterized in that the planer members advertise product class by virtue of shape and, or product specificity by virtue of recognizable print or symbol, such that a user changing the type of product for display changes the planer members of the construction base to generally and particularly advertise the new product type or types currently being presented by the display.

In some embodiments the base is a turntable rotatably mounted to a stand. In other embodiments the base is a pedestal. In still other embodiments the base is wall mountable.

In particular embodiments of the invention the one or more planer members are affixed to the base by insertion and seating thereof into one or more slots provided in the base. Also in some the one or more planer members are slotted and adapted to fit together and be mounted to the base. In some cases one of the planer members may be a backboard removably affixed to a base portion of a wall-mounted display.

In some cases the display in embodiments of the invention further comprises one or more of shelves, hooks, pins, pegs, or standoffs. Also in some cases the planar members are notched to hook to the base. The base may be a suspended platform and the one or more planner members for the suspension arm of the display.

In another aspect of the invention a method for visually advertising a product type or types displayed to the public using a display construction having a construction base and one or more planer members interfaceable with the construction base is provided, comprising steps of (a) providing the one or more planer members in the form of at least a shape or profile of likeness to one or more entities publicly recognized as associated with the product type or types; (b) adding the planer member or members to the display construction base; (c) adding the initial product type or types to the display construction; (d) removing the initial product type or types from the display construction; (e) removing the planner member or members from the display construction; (f) adding a new planer member or members of the shape or likeness of one or more entities publicly recognized as associated with a next displayed product or products to the display construction base; and (g) adding the new product or products to the display construction.

In preferred embodiments of the method, in steps (a) and (f), one or more of the planer members further include print and or logo to identify product specificity. Also in preferred embodiments, in steps (b) and (f), adding the planer member or members involves inserting the member or members into a slot or slots. The base may be one of a pedestal, a suspended platform, a wall-mounted base, or a turntable. Also the base may be mounted to a wall and one of the planer members may be a backboard removably affixed thereto. In still other cases the base may be a suspended platform and one of the planer members forms the suspension arm of the platform.

In yet another aspect of the invention a display apparatus for suggesting a three-dimensional entity is provided, comprising a first substantially planar member shaped as a cross-section through the three-dimensional entity at a first position, and a second planar member shaped as a cross-section through the three-dimensional entity at a second position, having a particular geometric relationship to the first position. The display apparatus is characterized in that the planar members are joined in the same geometrical relationship from which the cross-sections are derived, thereby creating a suggestion of the three-dimensional entity. In many embodiments planar members are suitably slotted to be joined to one another in the geometrical relationship.

In still another aspect of the invention a method for simulating a three-dimensional entity in an advertising display is provided, comprising the steps of (a) determining a first planar shape as a first cross-section of the three-dimensional entity taken at a first position relative to the three-dimensional entity; (b) creating a first planar element in the first planar shape; (c) determining a second planar shape as a second cross-section of the three-dimensional entity at a second position relative to the three-dimensional entity, the second position having a particular geometric relationship to the first position; (d) creating a second planar element in the second planar shape; and (e) joining the two planar elements in the particular geometric relationship, thereby creating a planar assembly suggesting the three-dimensional entity.

BRIEF DESCRIPTION OF THE DRAWING FIGURES

DESCRIPTION OF THE PREFERRED EMBODIMENTS

The inventor provides a method and apparatus for enabling a multiform-capable display having a generic base for displaying a variety of differing product classes and products according to several embodiments. The method and apparatus of the invention is described in enabling detail below.

Figure 1B:
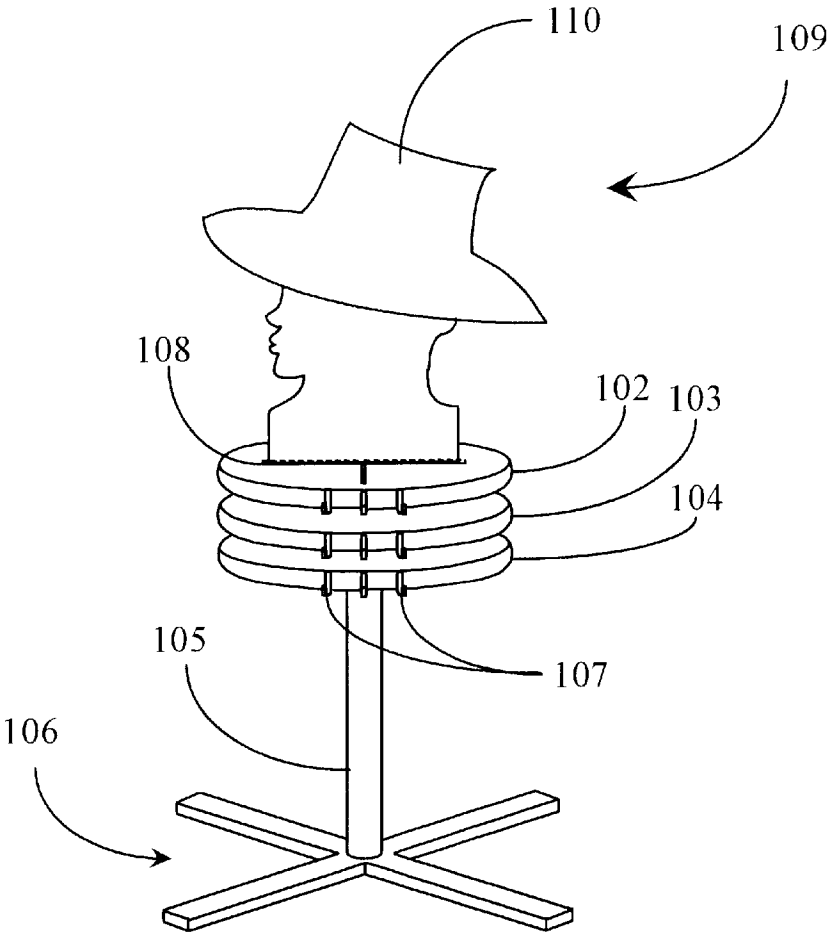
FIG. 1B is an elevation view of the display base of FIG. 1A supporting at least one planer member for indicating a different product class or specificity from that indicated in FIG. 1A.
Figure 1A:
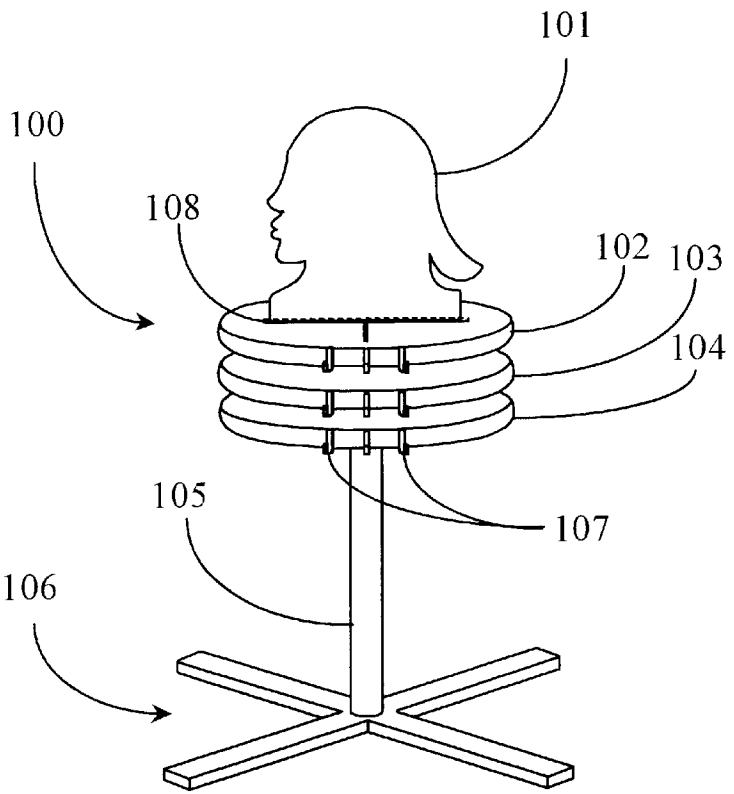
FIG. 1A is an elevation view of a display apparatus supporting at least one planer member for indicating class or specificity of a product according to an embodiment of the present invention.

FIG. 1A is an elevation view of a display apparatus 100 supporting at least one planer member 101 for indicating class of a product according to an embodiment of the present invention. Display apparatus 100 is exemplary of a display that might be used to present products that may be suspended from hooks, pins or pegs. Display 100 has a support stand 106 adapted to enable display 100 to stand upright on a flat surface. Stand 100 is simple in this example comprising a cross member construction.

Stand 106 has a column 105 affixed thereto in a position substantially centered and extending upward in a substantially perpendicular arrangement from stand 106. Column 105 has a plurality of annular discs rotatably affixed thereto illustrated herein as a disc 102, a disc 103, and a disc 104. Discs 102–104 are freely rotatable around column 105. Annular openings (not shown) are provided through center of discs 103, and 104 and partially through the center of disc 102 on the side facing column 105 and stand 106. The openings are provided of a diameter larger than that of column 105 at the positions of attachment so that free rotation of the discs is possible as with a turntable. Each disc 102, 103, and 104 is suitably spaced apart from adjacent discs.

Each disc 102, 103, and 104 has a plurality of hooks 107 affixed thereto around the periphery. Hooks 107 are adapted to suspend products presented on display to the public. Instead of hooks, clips, pegs, pins, clamps or similar apparatus may be provided. Although a limited number of hooks 107 are illustrated per disc, it may be assumed that the entire peripheral surface of each disc may be populated with hooks 107.

Stand 106, column 105, and discs 102, 103, and 104 may be manufactured of wood, a durable polymer, or any other suitable and common material used to build display apparatus. In a preferred embodiment of the invention, disc 102 has an elongated opening (slot) 108 laterally across the top face of the disc approximately along the diagonal center of the disc, although the position of the slot is not intended to be limiting in the invention. Slot 108 is adapted to accept a planer member 101 to be positioned substantially upright in on the disc face.

Planer member 101 is, in this particular example, provided in the recognizable shape or outline of the head of a woman or girl. Planer member 101 is of a suitable thickness so as to be pressed into slot 108 and be held thus secure. Planer member 101 is removable by hand and can be removed and replaced with another planer member of another shape or outline, having a common interface to slot 108.

In this embodiment, planer member 101 signifies the female gender implying that the products (not shown) that would be presented by display 100 with planer member 101 positioned thereon would be those used by ladies. Jewelry, woman's watches, makeup, and similar products might be displayed in this case. Provision of planer member 101 thus, by shape, and possibly by other indicia as well, indicates a class of products being displayed and not necessarily specificity of products. In this case display 100 is a generic display except for the provision of planer member 101.

It will be apparent to one with skill in the art that display 100 can take many other generic forms than the one illustrated in this example as long as it has an interface capable of accepting planer member 101 or other like planer members of other forms.

FIG. 1B is an elevation view of a display 109 having many common elements to that of display 100, but having a different planar member 110 for indicating a different product class from that indicated in FIG. 1A. Elements that were formerly introduced retain their same element numbers and are not re-introduced. In this example, a planer member 110 is provided and adapted to fit into slot 108 of disc 102. Planer member 110 is provided in the likeness of a man or boy wearing a hat. In fact, display 109 is identical to display 100 accept for the presence of planer member 110.

By switching planer members, vendors can use a constant generic display to advertise markedly different products. The planer members are designed for easy recognition from a considerable distance letting consumers know what product classes are available at the display. Display 110 would present products used by males.

In one embodiment, disc 102 may be cross-slotted to accept more than one planer member, with each planar member also slotted to allow the members to assemble together as slices of a three-dimensional entity. Additional planer members may be provided and inserted elsewhere on displays 100 or 109, such as along the vertical edge of column 105, for example. There are many possibilities. Planer members 101 (FIG. 1A) and 110 can be painted, engraved, and adorned with other elements, such as planer shelves for holding products. Planer members may be provided to resemble virtually any likeness, for example, people, animals, birds, automobiles, shapes of tools, and so on. Therefore, the displays themselves can take many forms.

Figure 2A:
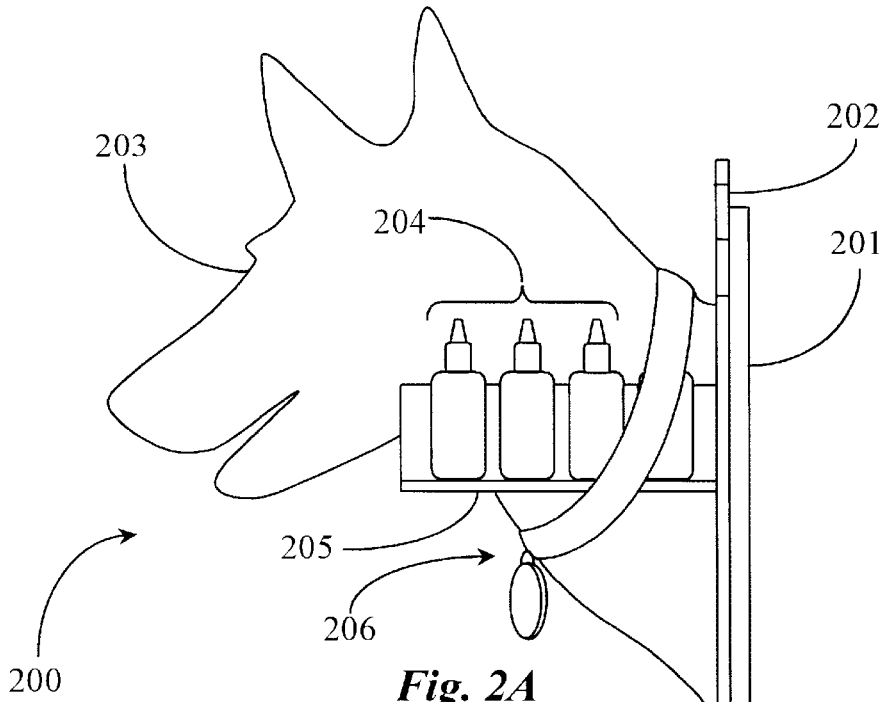
FIG. 2A is a side view of a wall-mounted display supporting at least one planer member and shelving for displaying a specific product class according to another embodiment of the present invention.

FIG. 2A is a side view of a wall-mounted display 200 supporting at least one planer member and shelving for displaying a specific product class according to another embodiment of the present invention. Display 200 is a wall-mounted display comprising a baseboard 201, a backboard 200, and a planer member 203.

Baseboard 201 is notched or otherwise tooled to enable wall mounting. Backboard 202 is essentially a flat signboard that provides a backdrop for the displayed product. Baseboard 201 and backboard 202 are typically fashioned of wood, a durable polymer, or any other suitable construction material commonly used to build displays.

Planer member 203 is, in this example, provided in the outline of a dog, like a German Sheppard or a Doberman Pincer. Planer member 203 is notched at its anterior extremity to fit into a slot provided vertically in backboard 202. Planer member 203 is of a thickness such that it may fit tightly into the slot in backboard 202 and be positioned securely. In one embodiment, pins are provided to secure member 203 to member 202, the pins retaining member 203 in vertical alignment and in substantially perpendicular position related to backboard 202.

Backboard 202 can be hand-removed from baseboard 201 and replaced with another backboard with a different likeness. Planer member 202 can be hand removed from backboard 202 and replaced with another planer member of a different likeness.

Planer member 203 in this example has at least 2 lateral slots (not shown) provided therein on opposite sides and in a substantially horizontal orientation. The slots are adapted to support shelving illustrated herein as shelving 205. Shelving 205 supports products illustrated herein as products 204. Backboard 202 also has slots (not shown) provided laterally across and vertically on either side of the position of planer member 203 for supporting the ends of shelving 205. Therefore, shelving 205 can be hand removed and installed.

Shelving 205 is, in this example, loaded with product 204 that would be used in conjunction with a dog, for example, flea drops, coat shine solution, or perhaps some other veterinarian solution. A dog collar 206 is illustrated in this example as an adornment for display 200.

Figure 2B:
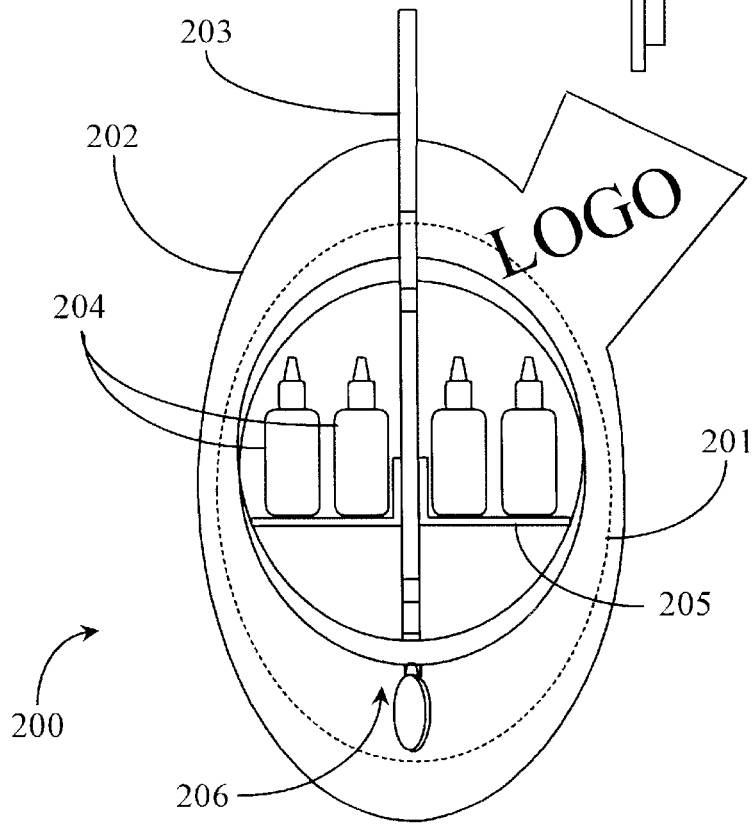
FIG. 2B is an elevation view of the display apparatus of FIG. 2A.

FIG. 2B is a front-elevation view of display 200 of FIG. 2A. In this view it can be seen that collar 206 fits around member 203 and the width of shelving 205 for a pleasing cosmetic effect. It can also be seen that backboard 202 has an area for placing a logo or some other printed media that may more specifically identify product 204. Planer member 203 can represent virtually any likeness. For example, planer member 203 can, in one embodiment, represent a classic palm tree and product 204 could be suntan lotion. There are many other possibilities. Display 200 can take forms to represent a wide variety of product classes as was described with reference to planer members 101 and 110 of FIGS. 1A and 1B respectively.

In this example, the only generic portion of display 200 is baseboard 201. Planer member 203 can be removed from display 200 along with planer member 202 when another product type will be displayed. In this case, planer member 203 indicates product class while planer member 202 can indicate product specificity such as exact brand and description.

In one embodiment of the present invention, planer members adapted to display 200 are also adapted to be used in display 100 and 109 described with reference to FIGS. 1A and 1B respectively. Similarly, planer members adapted for the latter displays can be used in display 200. Therefore, a vendor who has rapidly changing or seasonal product lines can present those products using a minimum number of displays. A multi-product storefront would take less time to assemble. If the vendor is a trade show vendor, he or she would require less space for packing and storing display parts and more space for transporting products.

Figure 3B:
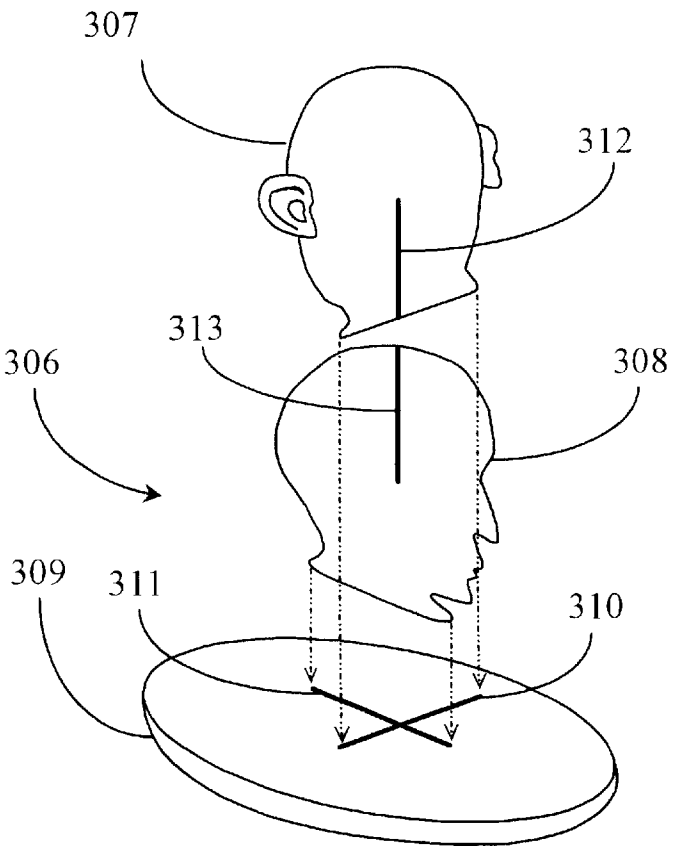
FIG. 3B is an assembly view of a pedestal display supporting more than one planer member assembled together according to yet another embodiment of the present invention.
Figure 3A:
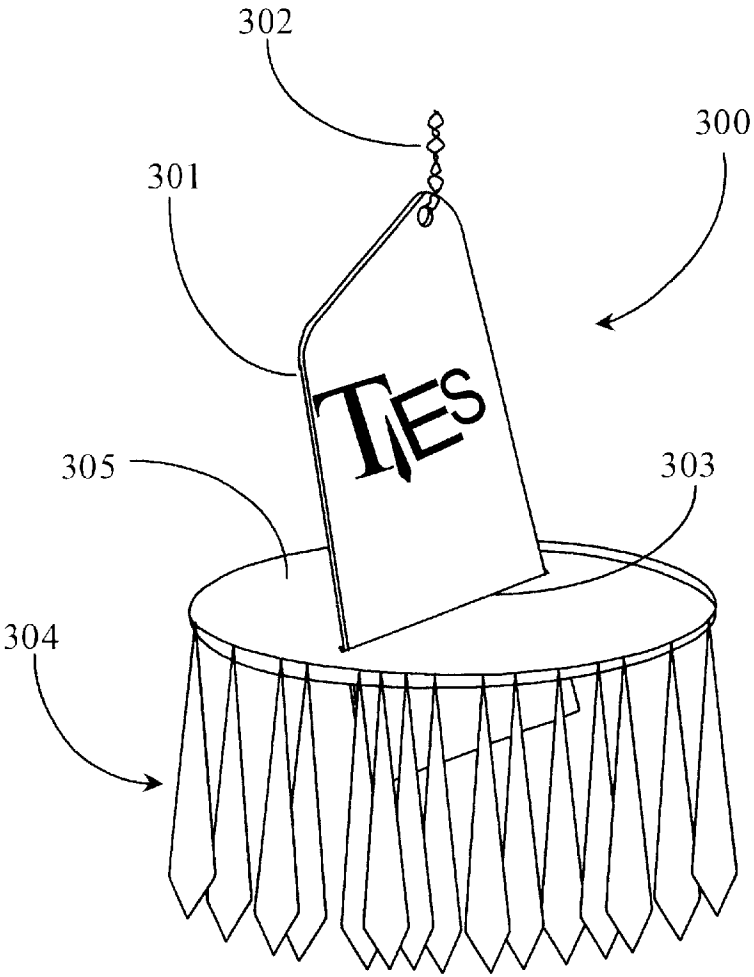
FIG. 3A is a perspective view of a suspended display apparatus supporting at least one planer member for display of a specific product according to an embodiment of the present invention.

FIG. 3A is a perspective view of a suspended display apparatus 300 supporting at least one planer member 301 for display of a specific product according to an embodiment of the present invention. Display 300 is a hanging display type. Planer member 301 is inserted up through a slot 303 provided through an annular base 305. Planer member 301 is narrower in width than the length of slot 303 at the suspension end, and wider than the slot length at the opposite end such that one may insert planer member 301 up through base 305 until the width of member 301 equals the length of slot 303 enabling a suspended presentation. A chain 302 is illustrated as the suspension medium although other mediums are certainly available.

Planer member 301 indicates product specificity by way of exhibiting the product type "TIES" in printed or painted lettering on one or both faces. Ties 304 are hung from clips or other suitable apparatus provided around the periphery of base 305. Planer member 301 and base 305 can be wood, a durable polymer or any other suitable material for building displays. Other planer members specifying other products can be inserted in place of member 301 when a different product is set up for presentation. Unlike the planer members described thus far, member 301 is product specific and not product class-identifying due to lack of a recognizable profile. However, planer members exhibiting a recognizable shape can also be provided in a form to be useable in display 300, and planar members may also be provided in a manner to indicate specific slices through a three-dimensional entity, as previously described.

FIG. 3B is an assembly view of a pedestal display 306 supporting more than one planer member 307 and 308 assembled together according to yet another embodiment of the present invention. Display 306 represents a simple pedestal or table top display for presenting a specific demo or model of a certain type of product.

Display 306 has an annular base 309. Base 309 may be manufactured of wood, a durable polymer, or any other suitable construction material commonly used in building displays. Base 309 is cross-slotted by a slot 310 and a slot 311. There may be more slots positioned at yet different angles. Slot 311 is adapted to accept a planer member 308 as illustrated by assembly arrows. Planer member 308 has a thickness adapted to fit snugly into slot 311 so as to assume a substantially upright position when inserted.

Planer member 308 has an elongated notch or slot 313 placed vertically therethrough to a suitable depth for accepting a similarly notched or slotted (312) planer member 307. Planer member 307 fits over planer member 308 forming a crossed assembly with member 307 seating within slot 310.

When fully assembled, display 306 exhibits a profile of a human head with one plane indicating front-to-back shape, and the other side-to-side shape. This display may be used to show a demo or model of an earmuff product, a headset telephone, or any other product that may fit on the display using the ear-stand as a mounting point. The use of such planar members suggests the three-dimensional entity to a viewer, without the necessity of a much more complicated, and therefore more expensive, display.

In some embodiment of the present invention any generic core or base of a display may have more than one or a few interfaces for accepting planer members. Furthermore, planner members may be part of a planer assembly that itself is adapted to interface with a generic core of a display.

The method and apparatus of the present invention can be used by any type of retail vendor and may be used to present virtually any type or class of products. In one embodiment a single display core may have one or more shape-specific planer members attached thereto that indicate a product class and one or more sub-display cores also assembled thereto, the sub cores having planer members associated therewith that narrow down the specific products presented.

One with skill in the art of physical presentation of products will appreciate that a form-assuming display is advantageous from the viewpoint of product recognition, ease of set-up and tear down, and storage requirements. The present invention is specifically useful to those vendors having rapidly or constantly changing product lines.

The methods and apparatus of the present invention should be afforded to broadest possible scope under examination. The spirit and scope of the present invention is limited only by the following claims.

What is claimed is:

1. A method for visually advertising a product type or types displayed to the public using a display construction having a construction base and one or more planer members interfaceable with the construction base comprising steps of;

(a) providing the one or more planer members in the form of at least a shape or profile of likeness to one or more entities publicly recognized as associated with the product type or types;

(b) adding the planer member or members to the display construction base;

(c) adding the initial product type or types to the display construction;

(d) removing the initial product type or types from the display construction;

(e) removing the planner member or members from the display construction;

(f) adding a new planer member or members of the shape or likeness of one or more entities publicly recognized as associated with a next displayed product or products to the display construction base; and (g) adding the new product or products to the display construction.

2. The method of claim 1 wherein in steps (a) and (f) one or more of the planer members further include print and or logo to identify product specificity.

3. The method of claim 1 wherein in steps (b) and (f) adding the planer member or members involves inserting the member or members into a slot or slots.

4. The method of claim 1 wherein in step (b) the base is one of a pedestal, a suspended platform, a wall-mounted base, or a turntable.

5. The method of claim 4 wherein in step (b) the base is mounted to a wall and one of the planer members is a backboard removably affixed thereto.

6. The method of claim 4 wherein in step (b) the base is a suspended platform and one of the planer members forms the suspension arm of the platform.

* * * * *